United States Patent [19]

Larry

[11] 4,213,202

[45] Jul. 22, 1980

[54] SHOCK DISTRIBUTING PANEL

[76] Inventor: Ronald G. Larry, 2426 Mulberry, Bloomfield Hills, Mich. 48013

[21] Appl. No.: 16,880

[22] Filed: Mar. 2, 1979

[51] Int. Cl.[2] ..... A41D 13/00

[52] U.S. Cl. ..... 2/2

[58] Field of Search ..... 2/2, 2.5, 16, 22, 24, 2/62

[56] References Cited

U.S. PATENT DOCUMENTS

| | | | |
|---|---|---|---|
| 573,919 | 12/1896 | Rice | 2/2 |
| 2,657,385 | 11/1953 | Cushman et al. | 2/2 |
| 3,550,159 | 12/1970 | Alarco | 2/2 |
| 3,995,320 | 12/1976 | Zafuto | 2/2 |

FOREIGN PATENT DOCUMENTS

| | | | |
|---|---|---|---|
| 847205 | 6/1939 | France | 2/2.5 |

*Primary Examiner*—H. Hampton Hunter

*Attorney, Agent, or Firm*—Basile, Weintraub & Hanlon

[57] ABSTRACT

A shock distributing panel for use in protective athletic sportswear is disclosed. The shock distributing panel comprises an outer flexible sheet, an inner flexible sheet spaced from the outer sheet, and a center flexible sheet dispersed between the inner sheet and the outer sheet. A plurality of shock distributing bellows are disposed between the outer sheet and the center sheet, and between the inner sheet and the center sheet. The bellows are spaced apart in alternate rows forming a honey comb arrangement with a void between bellows. The bellows disposed between the outer sheet and the inner sheet are axially centered over the void between bellows of the inner sheet and the center sheet. Light weight protective garments are disclosed for the upper body and lower body of athletes made from the panel of the present invention.

9 Claims, 7 Drawing Figures

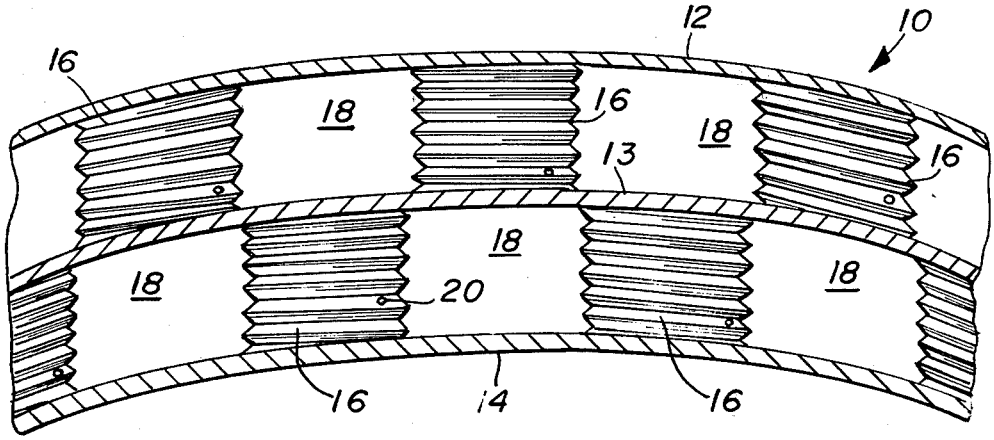
FIG-1
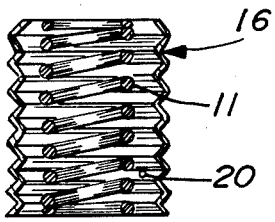
FIG-3
FIG-2
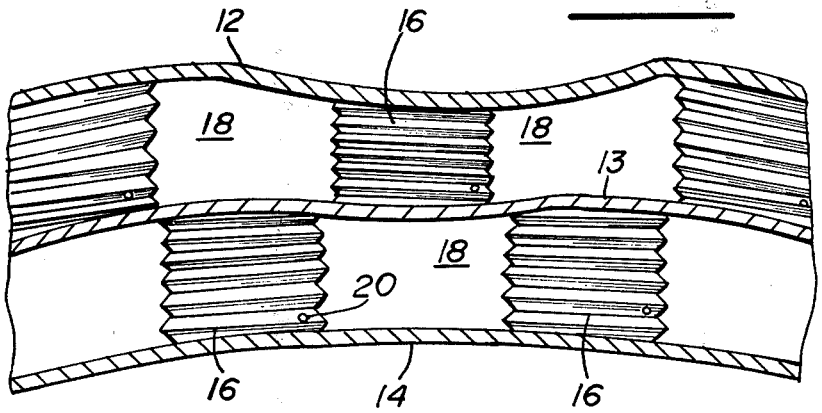

FIG-4
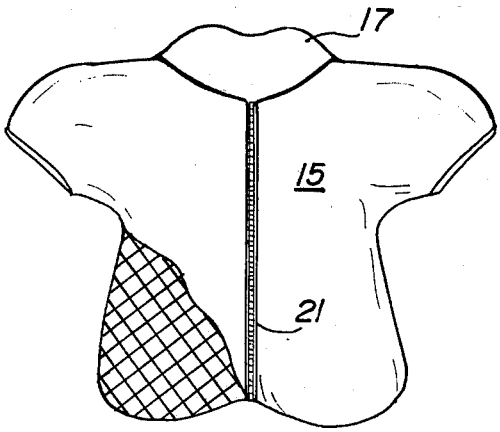
FIG-7
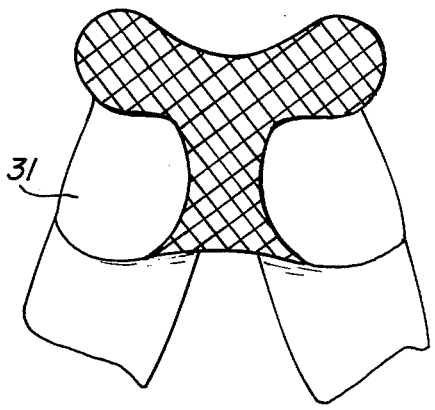
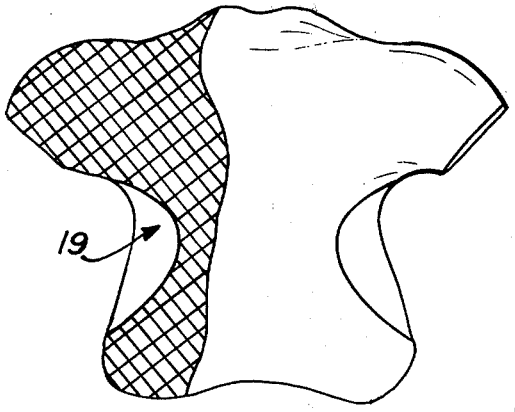
FIG-6
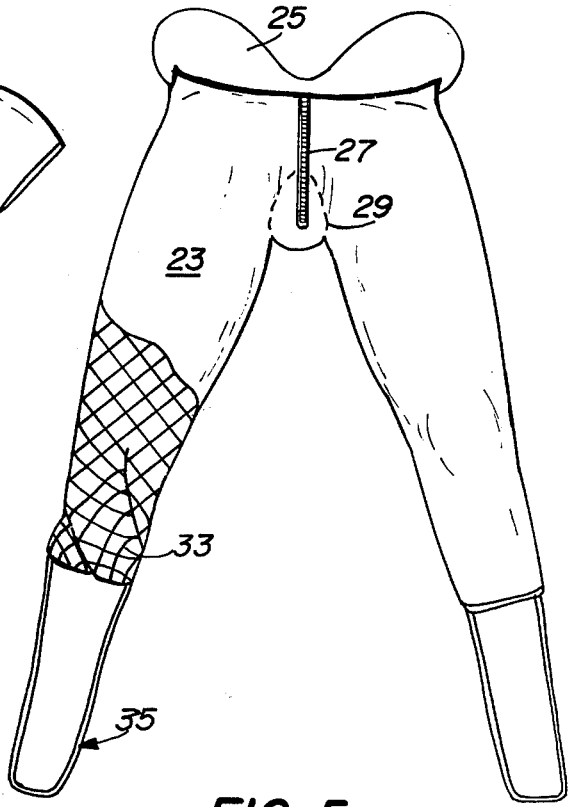
FIG-5

SHOCK DISTRIBUTING PANEL

BACKGROUND OF THE INVENTION

1. Field of the Invention

The present invention relates to the field of shock distributing or shock absorbing panels. More particularly the present invention relates to the field of shock distributing panels employed in protective garments for athletes. Even more particularly the present invention relates to the field of shock distributing panels employed in protective athletic garments for players engaged in body contact sports such as football or hockey.

2. Prior Art Statement

Shock absorbing panels and apparatus for protecting athletes from injury have long been known. The known devices include laminations of rigid material separated by resilient material such as closed cell or open cell neoprene. Apparatus of this type are included in U.S. Pat. Nos. 909,215; 2,867,813; 3,044,075; 3,135,961; 3,259,910; and 3,500,472. Other protective devices have employed springs to separate layers of semi rigid material using the springs to cushion a blow. U.S. Pat. Nos. 120,629; 573,919; 2,306,362 disclose apparatus employing springs to absorb shock in athletic protective equipment. U.S. Pat. Nos. 2,777,127 and 3,742,517 disclose an apparatus to conform to the portion of the body that is to be protected with a rigid outer layer spaced from a panel in contact with the wearers body. U.S. Pat. No. 2,657,385 discloses a protective pad with a rigid outer layer and a plurality of closed pneumatic tubes layered one upon another for cushioning a shock or impact to the rigid outer layer. A center panel spaced from the rigid outer panel is separated from the outer panel by a layer of interconnected closed pneumatic tubes. U.S. Pat. No. 2,657,385 does not disclose an outer flexible sheet, an inner flexible sheet spaced from the outer flexible sheet, and a center flexible sheet interposed between the inner sheet and the outer sheet with a plurality of shock distributing bellows disposed between the sheets. Nor does this patent disclose a plurality of bellows arranged in a honey comb fashion with the adjacent edges of the bellows sealed forming a chamber between bellows. Nor does this patent disclose an aperture between the bellows and the adjacent void to allow the bellows to raise pressure in the adjacent void when compressed.

The above listed U.S. patents constitute the entire prior art known to the inventor.

SUMMARY OF THE INVENTION

The present invention comprises a shock distributing panel comprising an outer flexible sheet, an inner flexible sheet spaced from the outer sheet, a center flexible sheet disposed between the inner sheet and the outer sheet, and a plurality of shock distributing bellows disposed between the outer sheet and the center sheet and between the inner sheet and the center sheet. The bellows are spaced apart in alternate rows in a honey comb fashion forming a void between bellows. The bellows are affixed to each other at their corners to form an air tight void. A plurality of apertures interconnect each bellows with its adjacent voids. Each bellows is resiliency biased to an extended position by either the resiliency of the material from which it is made or by a biasing spring enclosed within each bellows.

While in a preferred embodiment the bellows are formed to be naturally biased in their extended position.

In some cases, however, it may be desirable to have a greater stiffness than the bellows material will permit. In this case a spring encased within the bellows is used to stiffen the bellows. Varying the stiffness of the spring easily varies the stiffness of the spring and bellows combined.

A shock or impact applied to the outer sheet compresses the bellows closest to the point of impact, and the bellows compresses to absorb the shock. Compressing of the bellows causes air to be expelled from the bellows through the apertures into the adjacent voids tending to raise the pressure in the voids and spreading the shock over the adjacent areas.

The panel of the present invention may be formed into a protective sportswear garment to protect the lower body and the upper body of an athlete. The protective garment is formed to comfortably fit the user's body. A lower body protective garment covers the user's hips and legs from an upper edge at the hips to a point below the knee surrounding the legs from the crotch down. A slide fastener is provided at the front portion of the garment extending from the upper edge to the crotch. A rigid cup integral with the garment is disposed in the crotch area to protect the user's genitals. Material is removed in the buttocks area to provide ventilation and add to the comfort of the user. A pair of strips of panel material are disposed on either side of the knees beginning at a point above the knee, the strips extend downward and across the knee crossing at the knee and terminating at a point below the knee. A pair of stirrups of elastic material one for each leg are attached to the lower end of the garment at the sides looping under the user's foot to bias the lower end of the garment downward. The downward biasing provides added lateral protection to the athletes knees due to the cross biasing of the panel at the knees.

For a more complete understanding of the present invention, reference is made to the following detailed description and accompanying drawings.

Other objects, advantages, and applications of the present invention will become apparent to those skilled in the field to which the invention pertains, when the accompanying description of the best modes contemplated for practicing the invention are read in conjunction with the accompanying drawings.

BRIEF DESCRIPTION OF THE DRAWINGS

In the drawings like reference numbers refer to like parts throughout the several views, and wherein:

FIG. 1 illustrates a cross-sectional view of the panel in the present invention;

FIG. 2 illustrates a cross-sectional view of a shock distributing bellows with a biasing spring contained therein;

FIG. 3 illustrates a cross-sectional view of the panel in FIG. 1 as it absorbs an externally applied force;

FIG. 4 illustrates a front view of an upper body protective athletic garment formed from the panel of the present invention;

FIG. 5 illustrates a front view of a lower body protective garment formed to protect the lower body of an athlete;

FIG. 6 is a rear view of the upper body protective garment of FIG. 4; and FIG. 7 is a rear view of the lower body protection garment of FIG. 5.

DESCRIPTION OF THE PREFERRED EMBODIMENT

Referring now to the drawing and in particular to FIGS. 1 through 3 wherein there is illustrated at 10 a shock distributing panel comprising an outer flexible sheet 12, an inner flexible sheet 14 spaced from the outer sheet, and a center sheet 13 disposed between the inner sheet and the outer sheet. The spacing between sheets is maintained by a plurality of shock distributing bellows 16 which are biased into their extended position. The bellows are spaced apart in alternate rows forming a void between bellows and the rows are staggered to form a honey comb effect. The corners of the bellows 16 where they touch an adjacent bellows are joined together to form an air tight void 18. The bellows are formed from a resilient plastic and are biased to their extended position and closed at their top and bottom to form an air tight enclosure. Each bellows 16 has a plurality of apertures 20 interconnecting an inner portion of the bellows to the adjacent voids 18.

When the bellows are compressed by the external force (FIG. 2) the air pressure within the bellows is raised and air is forced to exit from the apertures 20 into the adjacent voids raising the pressure within the voids. Once a force has been applied to the outer sheet 12 compressing the sheet toward the wearer's body the compression of the bellows near the point of application of the force stiffens the area around the point of application due to the increase in pressure at the point of application and the surrounding areas. The compression of the shock distributing bellows at the point of load application and the spreading of the pressure generated to the surrounding voids and bellows, distributes the shock over a much larger area of the wearers body. The area over which the load is distributed is at least ten times the area along the outer sheet 12 where the initial load has been applied.

The sheets 12, 13, and 14 have flexibility selected to provide the maximum amount of shock protection for the body. The flexibility of the sheets is varied in accordance with the areas of the body which are to be protected. Organic plastic poly blend sheets made of materials such as polyethylene, polypropylene, or polyvinyl chloride compounds can be used in the preferred embodiment. The flexibility of the sheets is varied by chemical composition.

Referring again to the drawings, and in particular to FIGS. 4 and 5 wherein there is illustrated protective athletic sportswear garments from the panel of the present invention. FIG. 4 comprises an upper body garment 15 formed to comfortably fit the user's body from a bottom edge above the hips extending upward to cover the shoulders and upper arms. An opening 17 is provided at the user's neck, a raised portion 9 along the rear of the opening 17 gives added neck support, and a pair of openings 19 under the user's armpits (FIG. 6) extends downward a distance short of the bottom edge and rearward a distance short of encircling the body to provide ventilation. A slide fastener 21 extends from the neck opening 17 to the bottom edge of the garment. A loose mesh fabric such as nylon covers the panel to give the garment shape and abrasion resistance.

Referring now to FIG. 5 wherein there is illustrated a lower body protective garment formed to comfortably fit the user's hips and legs from an upper edge 25 at the hips to a point below the knee, surrounding the legs from the crotch down. A slide fastener 27 extends along a front portion of the garment from the upper edge 25 thereof to the crotch. A raised portion 37 at the sides along the upper edge 25 provides protection for the wearer's hips and kidneys. A rigid cup 29 integral with the garment is disposed in the crotch area to protect the user's genitals. A pair of openings 31 over the user's buttocks (FIG. 7) provide ventilation and add to the comfort of the wearer. A loose mesh fabric such as nylon covers the entire garment giving it shape and abrasion resistance. A pair of strips of panels 33 are disposed on both sides of the knees beginning at a point above the knee. The strips extend downward and laterally across the knee crossing at the knee and terminating at a point below the knee. The crossing of the strips 33 over the knee provides a cross biasing of the panel providing additional protection for the athlete's knee.

A pair of stirrups 35 of elastic material one for each leg are attached to the lower end of the garment below the knee at the sides looping under the user's feet to bias the lower end of the garment downward. This downward biasing of the garment aids the cross biasing of the knees and enhances the fit and comfort of the garment, preventing knee injuries.

Conventional outerwear such as light football pants and jerseys are worn over the protective garments to display the team colors and identifying numbers.

It is readily apparent to the skilled artisan that the panel of the present invention can be used to form protective head gear for athletes as well. Protective head gear formed from the panel of the present invention affords a substantial improvement in comfort for the user due to its light weight, and a substantial increase in the protection is afforded the user due to the shock distributing characteristics of the panel.

While the panel of the present invention has been described hereinabove as being employed as protective athletic equipment, it is obvious to the skilled artisan that such a panel can be readily employed for a variety of other useful purposes such as a crash panel in aircraft and automobiles.

The bellows illustrated are square in cross section, however, bellows of hexagonal, round, or octagonal cross section will work equally well. The only requirement is that the bellows be joined together where they touch to form an air tight space between bellows.

Having thus described the invention, what is claimed is:

1. A shock distributing panel comprising:
an outer flexible sheet;
an inner flexible sheet spaced from the outer sheet;
a center flexible sheet disposed between the inner sheet and the outer sheet;
a plurality of shock distributing bellows disposed between the outer sheet and the center sheet, and between the inner sheet and the center sheet, the bellows between the outer and center sheets being laterally spaced apart from the bellows between the inner and center sheets in alternate rows and the bellows in each row being spaced apart from each other, thereby forming a void between bellows.

2. The shock distributing panel as defined in claim 1 further comprising:
an air-tight void between bellows formed by the corners of the bellows being joined.

3. The shock distributing panel as defined in claim 2 wherein the bellows are airtight with an aperture communicating with each adjacent void.

4. The shock distributing panel as defined in claim 3 wherein the bellows comprise a square cross section joined with adjacent bellows at each corner.

5. The shock distributing panel as defined in claim 1 wherein the outer flexible sheet, the inner flexible sheet, and the center flexible sheet comprise a material of programable flexibility.

6. The shock distributing panel of claim 2 formed into a protective athletic sportswear garment formed to comfortably fit the user's body from a bottom edge above the hips extending upward to cover the shoulders and upper arms;

an opening for the user's neck;

a pair of openings under the user's armpits extending downward short of the bottom edge and rearward a distance short of encircling the body;

a slide fastener extending from the neck opening to the bottom edge; and a loose mesh fabric covering the panel.

7. The shock distributing panel of claim 2 formed into a protective sportswear garment comprising:

a lower body protective garment formed to comfortably fit the user's hips and legs from an upper edge at the hips to a point below the knee, surrounding the legs from the crotch down;

a slide fastener at a front portion of the garment extending from the upper edge to the crotch;

a rigid cup integral with the garment disposed in the crotch area to protect user's genitals;

a pair of openings over the user's buttocks; and a loose mesh fabric covering the panel.

8. The garment as defined in claim 7 further comprising:

a pair of strips of panel disposed on both sides of the knees beginning at a point above the knee, the strips extending downward and laterally across th? knee crossing at the knee, and terminating below the knee;

a pair of stirrups of elastic material, one for each leg attached to the lower end of the garment at the sides, looping under the user's foot to bias the lower end of the garment downward.

9. The shock distributing panel as defined in claim 3 further comprising a spring within the bellows biasing the bellows to an extended position.

* * * * *